United States Patent [19]

Maurer

[11] 4,000,238

[45] Dec. 28, 1976

[54] METHOD FOR PRODUCTION OF SYNTHETIC YARNS

[75] Inventor: Charles Jay Maurer, Charlotte, N.C.

[73] Assignee: Fiber Industries, Inc., Charlotte, N.C.

[22] Filed: Nov. 1, 1973

[21] Appl. No.: 411,999

Related U.S. Application Data

[62] Division of Ser. No. 230,262, Feb. 29, 1972, abandoned.

[52] U.S. Cl. ..... 264/176 F; 264/136; 264/211; 264/234

[51] Int. Cl.[2] ..... D01D 5/10; D01F 1/02

[58] Field of Search ..... 264/210 F, 136, 234, 264/176 F, 211; 117/126, 138.8; 260/873

[56] References Cited

UNITED STATES PATENTS

| | | | |
|---|---|---|---|
| 2,990,236 | 6/1961 | Riseley | 264/168 |
| 3,120,027 | 2/1964 | Baggett et al. | 264/210 F |
| 3,425,862 | 2/1969 | Eakins | 117/126 |
| 3,711,898 | 1/1973 | Debbas | 19/155 |
| 3,737,262 | 6/1973 | Klein | 264/176 F |
| 3,738,864 | 6/1973 | Altau | 117/138.8 F |

*Primary Examiner*—Jay H. Woo
*Attorney, Agent, or Firm*—Herbert M. Adrian, Jr.

[57] ABSTRACT

An apparatus and a method is disclosed for the production of synthetic filament yarns containing substantial portions of additives which retain or develop a stickiness under certain yarn spinning conditions. Such additives cause the individual filaments in the yarn to adhere to each other under hot, humid spinning conditions such as are countered more particularly in nylon spinning-steam conditioning. The apparatus disclosed is a convergence guide which brings the filaments together in the spinning column just prior to the steam conditioner, but in so converging the filaments, maintains the individual filaments in a spaced relationship to each other such that they remain separate from each other as they pass through a steam conditioner.

5 Claims, 3 Drawing Figures

METHOD FOR PRODUCTION OF SYNTHETIC YARNS

This is a division, of application Ser. No. 230,262, filed Feb. 29, 1972 now abandoned.

BACKGROUND OF THE INVENTION

In the production of synthetic filament yarns, it is becoming increasingly more desirable to add to the fiber forming polymer substantial portions of additives which affect the properties of the resulting filament. In many instances, the additives are not fiber-forming materials and in many instances, they are not miscible or have incompatibility characteristics with the polymer being spun into fibers. Such additives have been increasingly required to provide improvements in fire retardancy, antistatic charcteristics, antisoiling properties and the like desirable changes in physical properties in the fibers.

Because of the different properties and often because of the immiscibility of such additives with the fiber-forming polymer, spinning difficulties are often encountered due to the changes in the physical properties of the filaments in the as-spun condition. For instance, the additives may retard the solidification or the crystallinity formation of the fiber, the temperature at which the fiber hardens, or the additives may result in a retained surface stickiness of the filament for a period of time after initial hardening of the fiber. Consequently, conventional spinning techniques sometimes produce inferior yarns when such additives are present. The delayed solidification or retained stickiness causes the individual filaments to stick together when the yarn is converged in the spinning column particularly as it is in nylon spinning just prior to steam conditioning. The filament adhesion results in what is referred to as "taping" wherein the individual fibers adhere to each other in a ribbon like form. Such taping during spinning inhibits the filaments to form a normal yarn bundle of individual discrete filaments.

It has been discovered that if the filaments can be successfully taken up without taping, difficulties in further processing are not encountered. The problem which arises with respect to filament adhesion does not reoccur if the filaments are successfully taken up without such adhesion after spinning. Presumably, the final cooling of the yarn and application of the spin finish eliminates such further problems.

It is an object of the present invention to provide an apparatus to converge a plurality of as-spun filaments in a spinning column which apparatus further retains such converged filaments separate from each other for passage through a steam conditioner tube.

It is another object of the present invention to provide a method whereby synthetic fibers containing substantial amounts of additives can be spun in conventional spinning columns without the filaments sticking to each other.

These and other objects will become apparent from a description of the invention which follows.

DESCRIPTION OF THE INVENTION

In accordance with the invention, an apparatus is provided for converging as-spun yarn in a spinning column prior to takeup wherein said apparatus provides a yarn guide means having a flattened, U-shaped yarn contact portion, said flattened yarn contact portion being sufficiently straight and wide so as to accommodate a multifilament yarn in a flattened band with individual filaments distributed in a side-by-side parallel spaced apart relationship to each other on passing in contact with said flattened bottom portion, said guide means being positioned in a spinning column prior to taking up said filaments as a yarn. Preferably the guide means is positioned in proximity to the entrance to a steam conditioner wherein the guide means directs the filaments through the steam conditioner in a parallel spaced apart relationship.

The invention further provides a method for spinning a synthetic filament yarn utilizing a steam conditioner wherein the yarn contains a substantial proportion of an additive which causes the filaments in said yarn to adhere to one another during the spinning process prior to takeup, the improvement comprising extruding a plurality of filaments into a spinning column, quenching said filaments and subsequently converging said quenched filaments into a flattened band of spaced apart individual filaments representing a yarn, maintaining said filaments in said spaced apart, parallel relationship while passing said filaments through a steam zone and subsequently further converging said filaments into a yarn bundle for the application of a spin finish.

DETAILS OF THE INVENTION

The invention will be more fully described by reference to the drawings in which.

Figure 1:
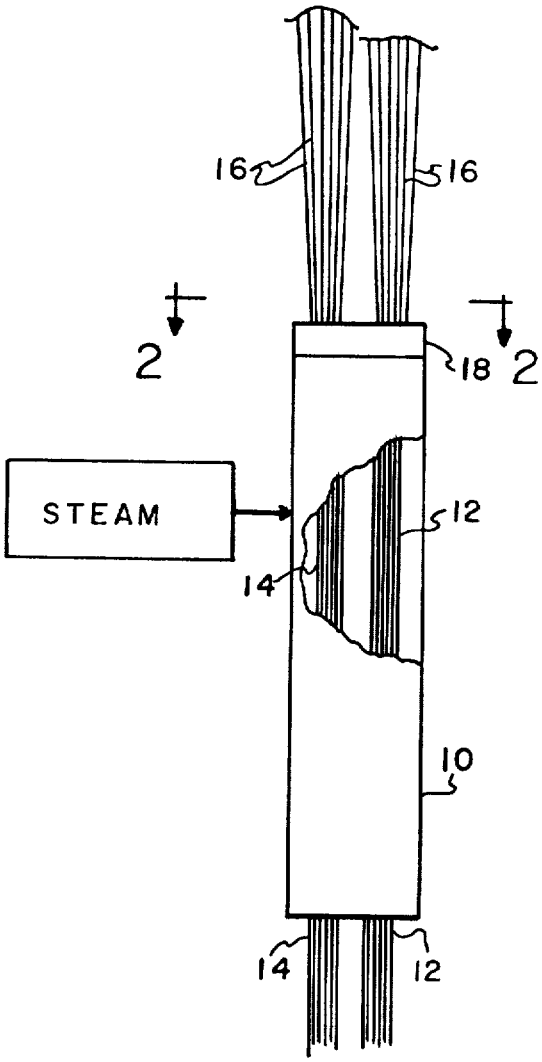
FIG. 1 is a partial schematic elevational view of a split threadline spinning column.

Referring more particularly to the drawings, FIG. 1 shows the interior of a spinning column having steam conditioning tube 10 located a suitable distance away from the spinneret (not shown) which distance is calculated to be sufficient to permit solidification of the extruded polymer prior to permitting the fiber to contact any surfaces.

The drawing illustrates a split threadline spinning process wherein two yarns, 12 and 14, are simultaneously spun in the same spinning column. Each yarn is made up of a plurality of individual filaments 16, which are converged by guide means 18 prior to entering steam conditioner tube 10. Guide means 18 is conveniently positioned on top of steam conditioner 10.

Figure 2:
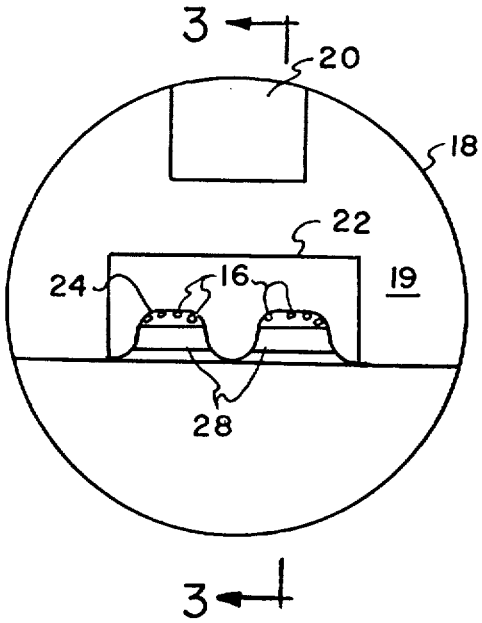
FIG. 2 is a plan view along line 2—2 of FIG. 1 showing the convergence guide apparatus of the present invention; and, FIG. 3 is a sectional view along line 3—3 of FIG. 2, revealing more detail of the apparatus of the present invention.
Figure 3:
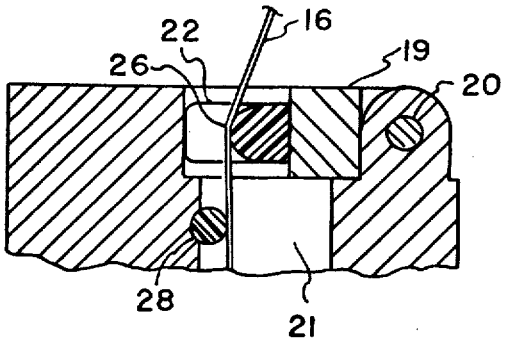

As illustrated more clearly in FIGS. 2 and 3, guide means 18 comprises a top portion 19 having hinge 20 thereon for access to a passageway 21, said top portion 19 having ceramic guide 22 positioned therein. Ceramic guide 22 is shaped in a flattened U having a separate U-shape for each yarn contact portion 24. The flattened portion 24 of the guide is sufficiently wide to accommodate all of the filaments comprising the yarn so that the filaments lie in a parallel, substantially straight spaced apart relationship to each other across the U. The flattened portion of the U preferably has a curved surface 26 so as to provide a tangential contact surface for filaments 16 as they travel across the guide 24 and become oriented parallel to the steam conditioner tube, which is inclined from the vertical. Such a curvature is of sufficiently small radius of curvature so as to provide a practical contact surface for the yarn while being of sufficiently large radius of curvature so as not to abrade the yarn as it passes across the guide. The curvature is particularly desirable because it has been found that by increasing the amount of contact distance the filaments make with guide surface, a more stable threadline is achieved, thereby reducing wandering of the individual filaments across the flattened guide surface, which leads to "taped" yarn.

Positioned directly below flattened, U-shaped guide 22 is guide pin 28. Guide pin 28 aids in maintaining the individual filaments in the flattened configuration of U guide 22, thereby effectively forming a narrow thin slot through which the filaments travel. Guide pin 28, while preferably being in the form of a cylindrical pin, can conveniently be in the shape of a bar if so desired. Such guide pin 28 and U guide 22 are preferably made of ceramic or other wear-resistant yarn guide materials as are well known in the art.

As has been noted above, the invention is particularly suitable for use in the spinning of nylon fibers such as nylon 6,6 (polyhexamethylene adipamide), nylon 6 (polycaprolactam), and the like wherein antistatic, antisoiling, fire retardant and the like additives have been added to the polymer melt. Such additives are often added in amounts of 2 to 25 percent by weight of the fiber-forming polymer and more often in the range of 4 to 15 percent of the fiber-forming polymer.

Molten polymer containing such additives is extruded into a spinning column as a plurality of filaments, quenched with air wherein the filaments are then converged through the described converging guide means prior to passing through a steam conditioner. It is well recognized in the art that it is preferred to condition freshly spun polyamide with steam so as to impart moisture and instigate crystallization prior to taking up the yarn onto packages. The described convergence guide is preferably mounted directly on top of the steam conditioner tube so as to converge the spun filaments into the described flattened band of individual spaced apart filaments and to so retain such spacing as the filaments pass through the steam conditioner. Filaments a short distance below the steam conditioner no longer exhibit the tendency to adhere to one another and therefore can be safely further converged into a yarn bundle. Conveniently, such further converging is accomplished during the application of a spin finish prior to taking up on a package or proceeding through one or more drawing steps.

The apparatus illustrated in the drawings shows the spinning of multiple threadlines, i.e. multiple yarns, in a single spinning column. However, it should be recognized that the present invention is equally applicable to the most common single threadline spinning. In the same manner, as will be immediately recognized by those skilled in the art, the invention is readily adaptable to any number of threadlines which could be spun in a single column.

While the invention has been more particularly described with reference to polyamides in which various additives have been incorporated therein, it is also readily recognized that such convergence guide can be used in the production of any synthetic filament yarn wherein it is desirable to converge the filaments while retaining them separate one from another. Thus, not only is such apparatus useful in melt spinning, but uses can also be found in dry and wet spinning such as cellulose acetate, cellulose triacetate, acrylic, modacrylic, rayon, as well as in the melt spinning of other synthetic fibers such as polyesters.

What is claimed is:

1. In a method for spinning a synthetic organic filament yarn, utilizing a steam conditioner wherein said yarn contains a substantial portion of an additive which causes the filaments in said yarn to adhere to one another during the spinning process prior to take-up, the improvement comprising extruding a plurality of filaments into a spinning column, quenching said filaments and subsequently converging said quenched filaments into a flattened band of spaced apart individual filaments representing a yarn, maintaining said filaments in said spaced apart parallel relationship while passing said filaments through a steam zone and subsequently further converging said filaments into a yarn bundle prior to takeup of the yarn.

2. The method of claim 1 wherein the filaments are further converged into a yarn bundle after the steam zone for the application of a spin finish.

3. The method of claim 1 wherein the filaments are melt spun polyamide filaments.

4. The method of claim 3 wherein the filaments are polyhexamethylene adipamide.

5. The method of claim 1 wherein the additive is in an amount of about 2 to 25% by weight and is selected from the group consisting of fire retardants, antistatic agents and copolymers.

* * * * *